US010160200B2

(12) United States Patent
Chikamoto

(10) Patent No.: US 10,160,200 B2
(45) Date of Patent: Dec. 25, 2018

(54) HEAD UNIT AND LIQUID EJECTING DEVICE

(71) Applicant: SEIKO EPSON CORPORATION, Tokyo (JP)

(72) Inventor: Motonori Chikamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/560,799

(22) PCT Filed: Mar. 22, 2016

(86) PCT No.: PCT/JP2016/001644

§ 371 (c)(1),
(2) Date: Sep. 22, 2017

(87) PCT Pub. No.: WO2016/152145

PCT Pub. Date: Sep. 29, 2016

(65) Prior Publication Data

US 2018/0111368 A1 Apr. 26, 2018

(30) Foreign Application Priority Data

Mar. 24, 2015 (JP) ..... 2015-060259

(51) Int. Cl.
*B41J 2/045* (2006.01)
*B41J 2/14* (2006.01)
*B41J 2/145* (2006.01)

(52) U.S. Cl.
CPC ..... *B41J 2/04541* (2013.01); *B41J 2/04581* (2013.01); *B41J 2/145* (2013.01); *B41J 2/14201* (2013.01); *B41J 2/14233* (2013.01); *B41J 2002/14241* (2013.01); *B41J 2002/14362* (2013.01); *B41J 2002/14491* (2013.01); *B41J 2202/11* (2013.01)

(58) Field of Classification Search
USPC ..... 347/49, 57, 78
See application file for complete search history.

(56) References Cited

U.S. PATENT DOCUMENTS 8,819,935 B2 * 9/2014 Fujita ..... B41J 2/161 29/890.1
8,899,730 B2 * 12/2014 Takemoto ..... B41J 2/055 347/57
2006/0268075 A1 11/2006 Sugahara et al.

FOREIGN PATENT DOCUMENTS

JP 2006-327031 A 12/2006
JP 2014-051008 A 3/2014

* cited by examiner

*Primary Examiner* — Lam Nguyen

(57) ABSTRACT

A head unit includes a structure and a driver IC. The driver IC includes: a first electrode group including first and second electrodes electrically connected to one ends of first and second actuators; a second electrode group including third and fourth electrodes electrically connected to one ends of third and fourth actuators; a third electrode group including electrodes electrically connected to the other ends of the first and second actuators; and a fourth electrode group including electrodes electrically connected to the other ends of the third and fourth actuators. The third electrode group is arranged along one side of the driver IC, the fourth electrode group is arranged along a side different from the one side, and an area where the first and second electrode groups are arranged is situated between an area where the third electrode group is arranged and an area where the fourth electrode group is arranged.

8 Claims, 10 Drawing Sheets

<DIAGONAL HEAD>

HEAD UNIT AND LIQUID EJECTING DEVICE

This application is a U.S. national phase application of PCT/JP2016/001644, which claims priority to Japanese Patent Application No. 2015-060259, filed on Mar. 24, 2015. The entire disclosure of Japanese Patent Application No. 2015-060259 is hereby incorporated herein by reference.

TECHNICAL FIELD

The present invention relates to a head unit and a liquid ejecting device.

BACKGROUND ART

A liquid ejecting device that ejects a liquid (e.g., ink) to print an image or a document is known. An ejection section that ejects the liquid typically includes a plurality of piezoelectric elements (piezo elements), and is configured so that a predetermined amount of liquid (e.g., ink) is ejected from a nozzle at a predetermined timing when a drive signal is supplied to one end of each piezoelectric element from a driver circuit.

It is necessary to increase the resolution of the product in order to obtain a high-quality and high-definition product by such a liquid ejecting device. It is necessary to increase the degree of integration of the ejection sections in order to increase the resolution. It is possible to increase the resolution that depends on the distance between the ejection sections by increasing the degree of integration of the ejection sections.

An integration technique that mounts (integrates) a driver IC that drives a piezoelectric element directly on an actuator substrate (structure) that includes a flow channel and a piezoelectric element provided to an ejection section has been known (see Patent Literature 1).

CITATION LIST

Patent Literature

PTL 1: JP-A-2014-51008

SUMMARY OF INVENTION

Technical Problem

It is necessary to reduce the nozzle arrangement pitch in order to increase the resolution. It is necessary to reduce the connection pitch with the driver IC when the nozzle arrangement is reduced. When the driver IC is mounted on the actuator substrate, the ejection section may malfunction (e.g., erroneous ink ejection) due to interference between the actuator substrate and the driver IC, and the quality of the product may deteriorate.

An object of several aspects of the invention is to provide technology that solves the problems that may occur when the driver IC is mounted on the actuator substrate.

Solution to Problem

According to one aspect of the invention, there is provided a head unit including:

a structure; and a driver IC, the structure including:

a first array that includes a plurality of ejection sections including a first ejection section that performs an ejection operation upon application of a drive signal to a first actuator, and a second ejection section that performs an ejection operation upon application of the drive signal to a second actuator; and a second array that includes a plurality of ejection sections including a third ejection section that performs an ejection operation upon application of the drive signal to a third actuator, and a fourth ejection section that performs an ejection operation upon application of the drive signal to a fourth actuator, the driver IC including:

a first electrode group that includes a plurality of electrodes including a first electrode that is electrically connected to one end of the first actuator and supplies the drive signal to the first actuator, and a second electrode that is electrically connected to one end of the second actuator and supplies the drive signal to the second actuator;

a second electrode group that includes a plurality of electrodes including a third electrode that is electrically connected to one end of the third actuator and supplies the drive signal to the third actuator, and a fourth electrode that is electrically connected to one end of the fourth actuator and supplies the drive signal to the fourth actuator;

a third electrode group that includes a plurality of electrodes that are electrically connected to the other end of the first actuator and the other end of the second actuator; and a fourth electrode group that includes a plurality of electrodes that are electrically connected to the other end of the third actuator and the other end of the fourth actuator, wherein, when the driver IC is viewed perpendicular to a mounting surface of the driver IC that is mounted on the structure, the third electrode group is arranged along one side of the driver IC, the fourth electrode group is arranged along a side of the driver IC that differs from the one side, and an area in which the first electrode group and the second electrode group are arranged is situated between an area in which the third electrode group is arranged and an area in which the fourth electrode group is arranged.

According to the head unit, the circuit area that supplies the relatively high-voltage drive signal is provided in the area in which the first electrode group and the second electrode group are arranged, and the circuit area that supplies the relatively low-voltage signal is provided between the area in which the third electrode group is arranged and the area in which the fourth electrode group is arranged. Therefore, it is possible to reduce or suppress the effect of a change in the voltage of the high-voltage signal on the peripheral area of the head unit (i.e., interference).

Note that the term "ejection operation" refers to an operation that ejects a liquid (e.g., ink).

In the head unit, a hold signal may be applied in common to the third electrode group and the fourth electrode group.

In the head unit, the third electrode group and the fourth electrode group may be formed over a non-doped region of the driver IC when viewed perpendicular to the mounting surface.

According to this configuration, since the third electrode group and the fourth electrode group are formed over the non-doped region, it is possible to reduce the effect of noise due to a current that flows through the other end of the actuator on the element (e.g., transistor) included in the driver IC, even when a large amount of current flows through the other end of the actuator. This makes it possible to suppress deterioration in the quality of the product. Note that the expression "A is formed over the non-doped region" means that A is formed after the non-doped region has been formed at a position included within the non-doped region when viewed perpendicular to the mounting surface, for example. Note that the expression "A is formed over B" used herein means that A is formed temporally after B during the production process, and is irrelevant to the position in the gravitational direction.

In the head unit, the area in which the first electrode group and the second electrode group are arranged may be isolated from each of the third electrode group and the fourth electrode group through a buffer area.

According to this configuration, even when a large amount of current flows through the other end of the actuator, noise due to the current that flows through the other end of the actuator rarely reaches the area in which the first electrode group and the second electrode group due to the presence of the buffer area.

In the head unit, a guard wiring section may be provided between the area in which the first electrode group and the second electrode group are arranged, and the area in which the third electrode group is arranged, and between the area in which the first electrode group and the second electrode group are arranged, and the area in which the fourth electrode group is arranged, when viewed perpendicular to the mounting surface.

According to this configuration, even when a large amount of current flows through the other end of the actuator, noise due to the current that flows through the other end of the actuator rarely reaches the area in which the first electrode group and the second electrode group are arranged due to the presence of the guard wiring section.

The above object can also be achieved by a head unit including:

a structure; and a driver IC, the structure including:

a first array that includes a plurality of ejection sections including a first ejection section that performs an ejection operation upon application of a drive signal to a first actuator, and a second ejection section that performs an ejection operation upon application of the drive signal to a second actuator; and a second array that includes a plurality of ejection sections including a third ejection section that performs an ejection operation upon application of the drive signal to a third actuator, and a fourth ejection section that performs an ejection operation upon application of the drive signal to a fourth actuator, the driver IC including:

a first circuit block that includes a first electrode group that includes a plurality of electrodes including a first electrode that is electrically connected to one end of the first actuator and a second electrode that is electrically connected to one end of the second actuator, and a second electrode group that includes a plurality of electrodes including a third electrode that is electrically connected to one end of the third actuator and a fourth electrode that is electrically connected to one end of the fourth actuator, and supplies the drive signal to the first electrode group and the second electrode group;

a second circuit block that includes a third electrode group that includes a plurality of electrodes that are electrically connected to the other end of the first actuator and the other end of the second actuator, and supplies a hold signal to the third electrode group; and a third circuit block that includes a fourth electrode group that includes a plurality of electrodes that are electrically connected to the other end of the third actuator and the other end of the fourth actuator, and supplies the hold signal to the fourth electrode group, wherein, when the driver IC is viewed perpendicular to a mounting surface of the driver IC that is mounted on the structure, the second circuit block is situated along one side of the driver IC, the third circuit block is situated along a side of the driver IC that differs from the one side, and the first circuit block is situated between the second circuit block and the third circuit block.

The invention is not limited to a head unit, and may be implemented in various other ways. For example, the invention may be applied to a liquid ejecting device that includes the above head unit. Note that the term "liquid ejecting device" used herein refers to a device that ejects a liquid. The liquid ejecting device may be a printer (described later), a three-dimensional printer (3D printer), a device (printer) that dyes cloth, or the like.

When the invention is applied to a liquid ejecting device, a plurality of head units may be arranged in parallel when viewed perpendicular to the liquid ejection plane.

DESCRIPTION OF EMBODIMENTS

Exemplary embodiments of the invention are described below with reference to the drawings taking a printer as an example.

Figure 1:
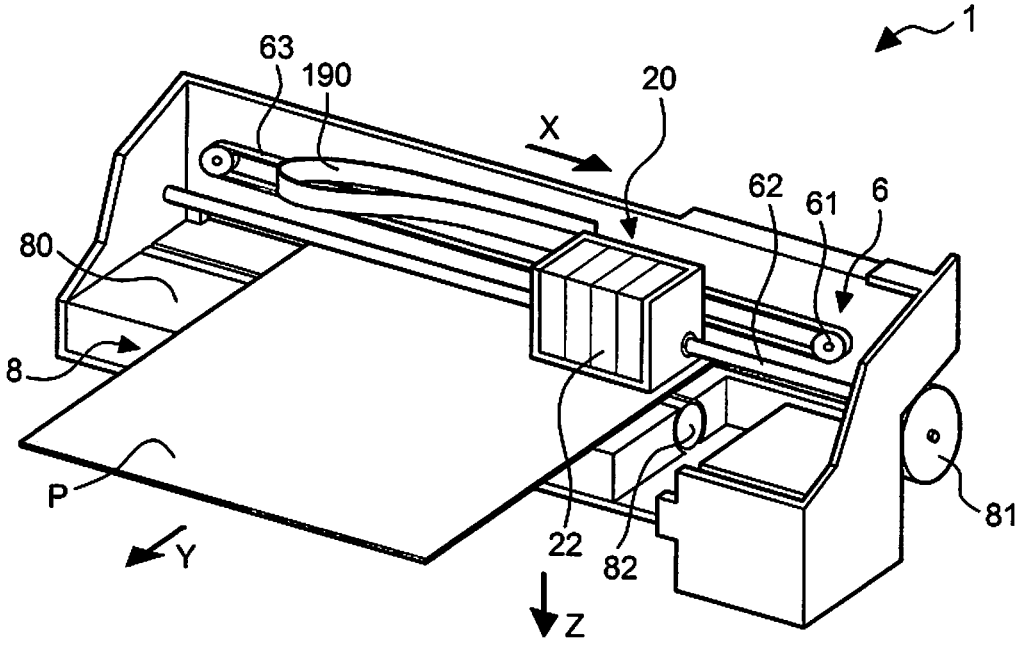
FIG. 1 illustrates a schematic configuration of a printer according to the first embodiment.

FIG. 1 is a perspective view illustrating a schematic configuration of a printer according to the first embodiment.

A printer 1 is a liquid ejecting device that forms ink dots on a medium P (e.g., paper) by ejecting an ink (i.e., liquid) to print an image (including a character, a figure, and the like).

As illustrated in FIG. 1, the printer 1 includes a moving mechanism 6 that moves (reciprocates) a carriage 20 in the main scan direction (X-direction).

The moving mechanism 6 includes a carriage motor 61 that moves the carriage 20, a carriage guide shaft 62 that is secured on each end, and a timing belt 63 that extends almost parallel to the carriage guide shaft 62, and is driven by the carriage motor 61.

The carriage 20 is reciprocally supported by the carriage guide shaft 62, and is secured on part of the timing belt 63. Therefore, when the timing belt 63 is moved forward and backward by the carriage motor 61, the carriage 20 reciprocates while being guided by the carriage guide shaft 62.

A print head 22 is provided to the carriage 20. The print head 22 includes a plurality of nozzles that are provided in an area opposite to the medium P, and independently eject the ink in the Z-direction. The print head 22 is schematically divided into four blocks in order to implement color printing. Each block ejects a black (Bk) ink, a cyan (C) ink, a magenta (M) ink, or a yellow (Y) ink.

Various signals and the like including a drive signal are supplied to the carriage 20 from a main board (not illustrated in FIG. 1) through a flexible cable 190.

The printer 1 includes a feed mechanism 8 that feeds the medium P on a platen 80. The feed mechanism 8 includes a feed motor 81 (i.e., drive source), and a feed roller 82 that is rotated by the feed motor 81, and feeds the medium P in the sub-scan direction (Y-direction).

An image is formed on the surface of the medium P by repeating an operation that ejects the ink from the nozzle of the print head 22, and feeds the medium P by using the feed mechanism 8 in synchronization with the main scan operation of the carriage 20.

In the first embodiment, the main scan operation is implemented by moving the carriage 20, and the sub-scan operation is implemented by feeding the medium P. Note that the print head 22 may be fixed, and the medium P may be moved in the X-Y-directions. Alternatively, both the carriage 20 and the medium P may be moved. It suffices that the medium P and the carriage 20 (print head 22) move relative to each other.

Figure 2:
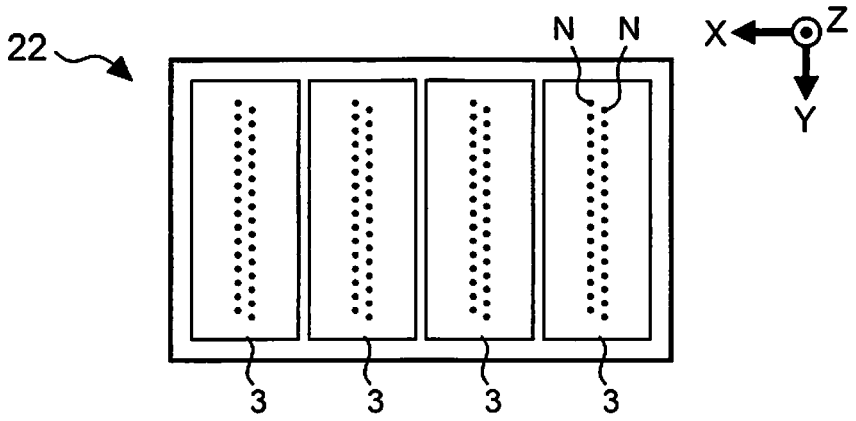
FIG. 2 is a plan view illustrating the configuration of a head unit.

FIG. 2 illustrates the ink ejection plane of the print head 22 when viewed from the medium P.

As illustrated in FIG. 2, the print head 22 includes four head units 3. The four head units 3 are arranged in the X-direction (i.e., main scan direction), and respectively correspond to black (Bk), cyan (C), magenta (M), and yellow (Y). Each head unit 3 includes a plurality of nozzles N that are arranged in two rows along the Y-direction. The head unit 3 has a structure in which a piezoelectric element (i.e., actuator) provided to an actuator substrate is sealed with a driver IC (as described in detail later).

The electrical configuration of the printer 1 is described below.

Figure 3:
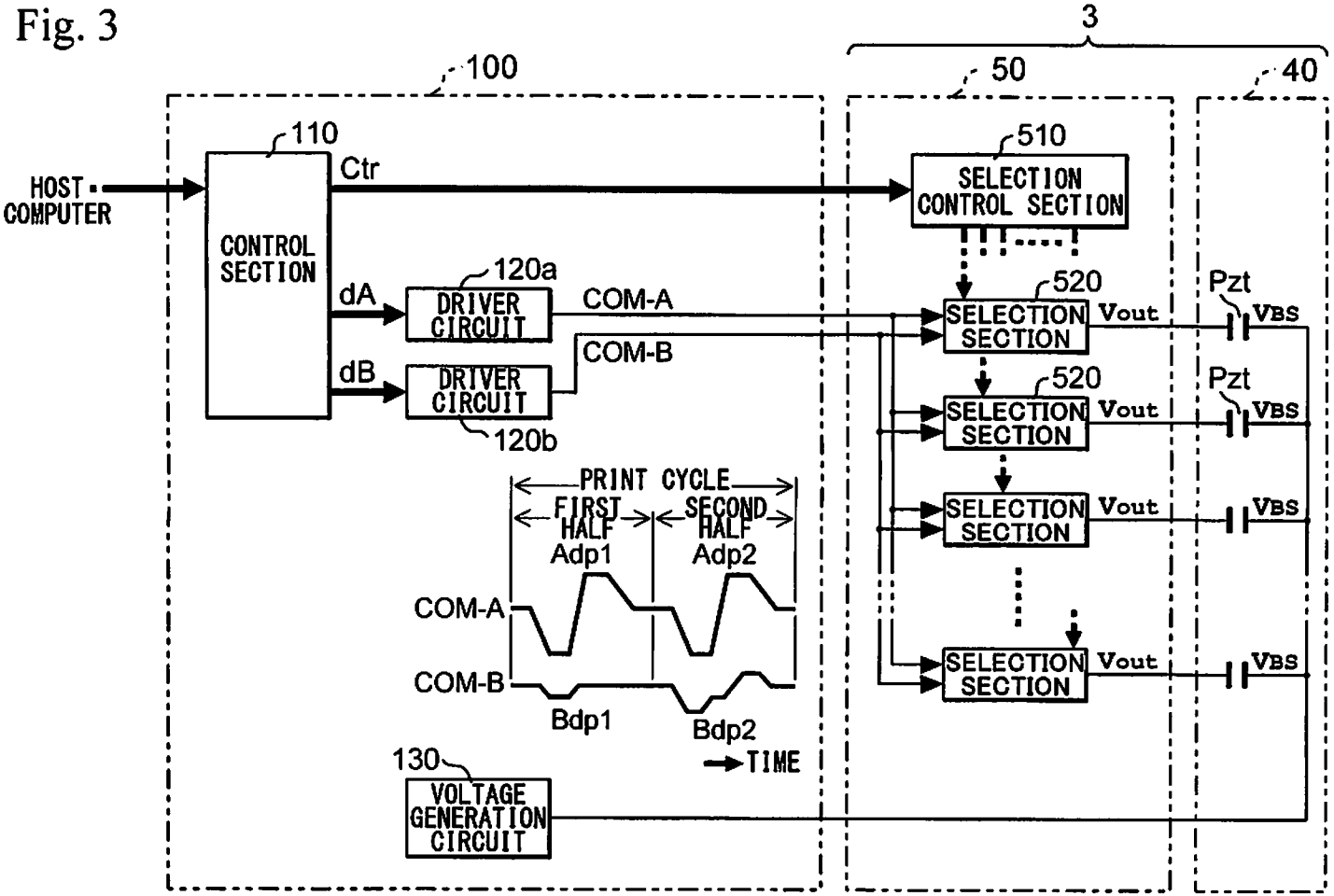
FIG. 3 illustrates the electrical configuration of a printer.

FIG. 3 is a block diagram illustrating the electrical configuration of the printer 1.

As illustrated in FIG. 3, the printer 1 has a configuration in which the head unit 3 is connected to a main board 100. The head unit 3 is roughly divided into an actuator substrate 40 and a driver IC 50.

The main board 100 supplies a control signal Ctr, a drive signal COM-A, a drive signal COM-B, and a voltage $V_{BS}$ hold signal to the driver IC 50, and the driver IC 50 supplies the drive signal to one end of each of a plurality of piezoelectric elements Pzt provided to the actuator substrate 40, and relays a voltage $V_{BS}$ to the other end of each of the plurality of piezoelectric elements Pzt.

The printer 1 has a configuration in which four head units 3 are provided, and the main board 100 controls the four head units 3 independently of each other. The four head units 3 are identical to each other except for the color of the ink that is ejected by each head unit 3. The following description focuses on one head unit 3 for convenience of explanation.

As illustrated in FIG. 3, the main board 100 includes a control section 110, driver circuits **120*a* and 120*b*, and a voltage generation circuit 130**.

The control section 110 is a microcomputer that includes a CPU, a RAM, a ROM, and the like. When image data that represents the print target has been supplied from a host computer or the like, the control section 110 executes a predetermined program to output various control signals and the like that control each section.

Specifically, the control section 110 repeatedly supplies digital data dA to the driver circuit **120*a*, and repeatedly supplies digital data dB to the driver circuit 120*b*. The data dA represents (defines) the waveform of the drive signal COM-A that is supplied to the head unit 3, and the data dB represents (defines) the waveform of the drive signal COM-B that is supplied to the head unit 3**.

The driver circuit **120*a* converts the data dA into an analog signal, subjects the analog signal to class-D amplification or the like, and outputs the amplified signal as the drive signal COM-A. Likewise, the driver circuit 120*b*** converts the data dB into an analog signal, amplifies the analog signal, and outputs the amplified signal as the drive signal COM-B.

Note that the driver circuits **120*a* and 120*b*** differ as to only the input data and the waveform of the drive signal to be output, and have an identical circuit configuration.

The control section 110 supplies various control signals Ctr to the head unit 3 in synchronization with the control process performed on the moving mechanism 6 and the feed mechanism 8. Note that the control signals Ctr supplied to the head unit 3 include print data that represents the amount of ink to be ejected from the nozzle N, a clock signal that is used to transfer the print data, and a timing signal that represents the print cycle and the like, for example. The control section 110 controls the moving mechanism 6 and the feed mechanism 8. The configuration for controlling the moving mechanism 6 and the feed mechanism 8 is known in the art, and description thereof is omitted.

The voltage generation circuit 130 included in the main board 100 generates and outputs the voltage $V_{BS}$ hold signal (that is constant temporally). Note that the voltage $V_{BS}$ is used to hold the other end of each of a plurality of piezoelectric elements Pzt provided to the actuator substrate 40 in a constant state.

In the first embodiment, the ink is ejected from each nozzle N up to twice in the print cycle so that each dot can represent four grayscales (large dot, medium dot, small dot, and non-recording). In the first embodiment, the drive signals COM-A and COM-B are provided, and the print cycle is divided into a first-half period and a second-half period in order to represent the above four grayscales. The drive signal COM-A or COM-B is selected (or the drive signals COM-A and COM-B are not selected) according to the target grayscale in each of the first-half period and the second-half period of the print cycle, and supplied to one end of the piezoelectric element Pzt.

The waveform of each of the drive signals COM-A and COM-B is described below.

As illustrated in FIG. 3, the drive signal COM-A has a waveform that includes a trapezoidal waveform Adp1 provided in the first-half period of the print cycle, and a trapezoidal waveform Adp2 provided in the second-half period of the print cycle, the trapezoidal waveform Adp1 and the trapezoidal waveform Adp2 being provided continuously. The trapezoidal waveforms Adp1 and Adp2 are almost identical to each other. When each of the trapezoidal waveforms Adp1 and Adp2 is supplied to one end of the piezoelectric element Pzt, a specified amount (i.e., medium amount) of ink is ejected from the nozzle N that corresponds to the piezoelectric element Pzt.

The drive signal COM-B has a waveform that includes a trapezoidal waveform Bdp1 provided in the first-half period, and a trapezoidal waveform Bdp2 provided in the second-half period, the trapezoidal waveform Bdp1 and the trapezoidal waveform Bdp2 being provided continuously. The trapezoidal waveforms Bdp1 and Bdp2 differ from each other. The trapezoidal waveform Bdp1 is a waveform that prevents an increase in the viscosity of the ink by finely vibrating the ink that is situated in the vicinity of the nozzle N. Therefore, when the trapezoidal waveform Bdp1 is supplied to one end of the piezoelectric element Pzt, an ink droplet is not ejected from the nozzle N that corresponds to the piezoelectric element Pzt. When the trapezoidal waveform Bdp2 is supplied to one end of the piezoelectric element Pzt, the ink is ejected from the nozzle N that corresponds to the piezoelectric element Pzt in an amount smaller than the specified amount.

Therefore, when forming a large dot, the drive signal COM-A (trapezoidal waveforms Adp1 and Adp2) are selected and supplied to one end of the piezoelectric element Pzt that corresponds to the nozzle N that is used to form a large dot in the first-half period and the second-half period of the print cycle so that a medium amount of ink is ejected twice from the nozzle N. The ink droplets reach the medium P and unite to form a large dot.

When forming a medium dot, the drive signal COM-A (trapezoidal waveform Adp1) is selected and supplied to one end of the piezoelectric element Pzt that corresponds to the nozzle N that is used to form a medium dot in the first-half period of the print cycle, and the drive signal COM-B (trapezoidal waveform Bdp2) is selected and supplied to one end of the piezoelectric element Pzt that corresponds to the nozzle N that is used to form a medium dot in the second-half period of the print cycle so that a medium amount of ink and a small amount of ink are sequentially ejected from the nozzle N. The ink droplets reach the medium P and unite to form a medium dot.

When forming a small dot, the drive signals COM-A and COM-B are not selected in the first-half period of the print cycle, and the drive signal COM-B (trapezoidal waveform Bdp2) is selected and supplied to one end of the piezoelectric element Pzt that corresponds to the nozzle N that is used to form a small dot in the second-half period of the print cycle so that a small amount of ink is ejected once from the nozzle N. The ink droplet reaches the medium P to form a small dot.

When it is unnecessary to form a dot (non-recording), the drive signal COM-B (trapezoidal waveform Bdp1) is selected and supplied to one end of the piezoelectric element Pzt that corresponds to the nozzle N in the first-half period of the print cycle, and the drive signals COM-A and COM-B are not selected in the second-half period of the print cycle so that the ink that is situated in the vicinity of the nozzle N finely vibrates only in the first-half period. Since the ink is not ejected from the nozzle N, a dot is not formed (non-recording).

The driver IC 50 included in the head unit 3 includes a selection control section 510, and selection sections 520 that correspond to the piezoelectric elements Pzt on a one-to-one basis. The selection control section 510 controls the selection operation performed by each selection section 520. More specifically, the selection control section 510 temporarily stores the print data supplied from the control section 110 in synchronization with the clock signal corresponding to several nozzles (piezoelectric elements Pzt) of the head unit 3, and instructs each selection section 520 to select the drive signal COM-A or COM-B according to the print data at the start timing of the print cycle (first-half period and second-half period) that is represented by the timing signal.

Each selection section 520 selects the drive signal COM-A or COM-B (or does not select the drive signals COM-A and COM-B) according to the instruction issued by the selection control section 510, and applies the selected drive signal COM-A or COM-B to one end of the corresponding piezoelectric element Pzt as a voltage Vout drive signal.

Since the selection control section 510 merely instructs the selection section 520 to select the drive signal COM-A or COM-B, the elements (transistors) that form the selection control section 510 can be designed according to a low-voltage specification.

Since the maximum voltage of the drive signal COM-A is about 40 V, the elements (transistors) (including a level shifter that converts the output from the selection control section 510 into a high-amplitude signal) that form the selection section 520 are designed according to a high-voltage specification so as to withstand such a high voltage.

The piezoelectric elements Pzt (actuators) are provided to the actuator substrate 40 so as to have a one-to-one relationship with the nozzles N. The other end of each of the piezoelectric elements Pzt is electrically connected in common, and the voltage $V_{BS}$ generated by the voltage generation circuit 130 is applied to the other end of each of the piezoelectric elements Pzt.

The voltage Vout applied to one end of each of the piezoelectric elements Pzt changes corresponding to the size of the dot to be formed, and the voltage VBS is applied in common to the other end of each of the piezoelectric elements Pzt. Therefore, a relatively large amount of current flows through the voltage $V_{BS}$ path.

Figure 4:
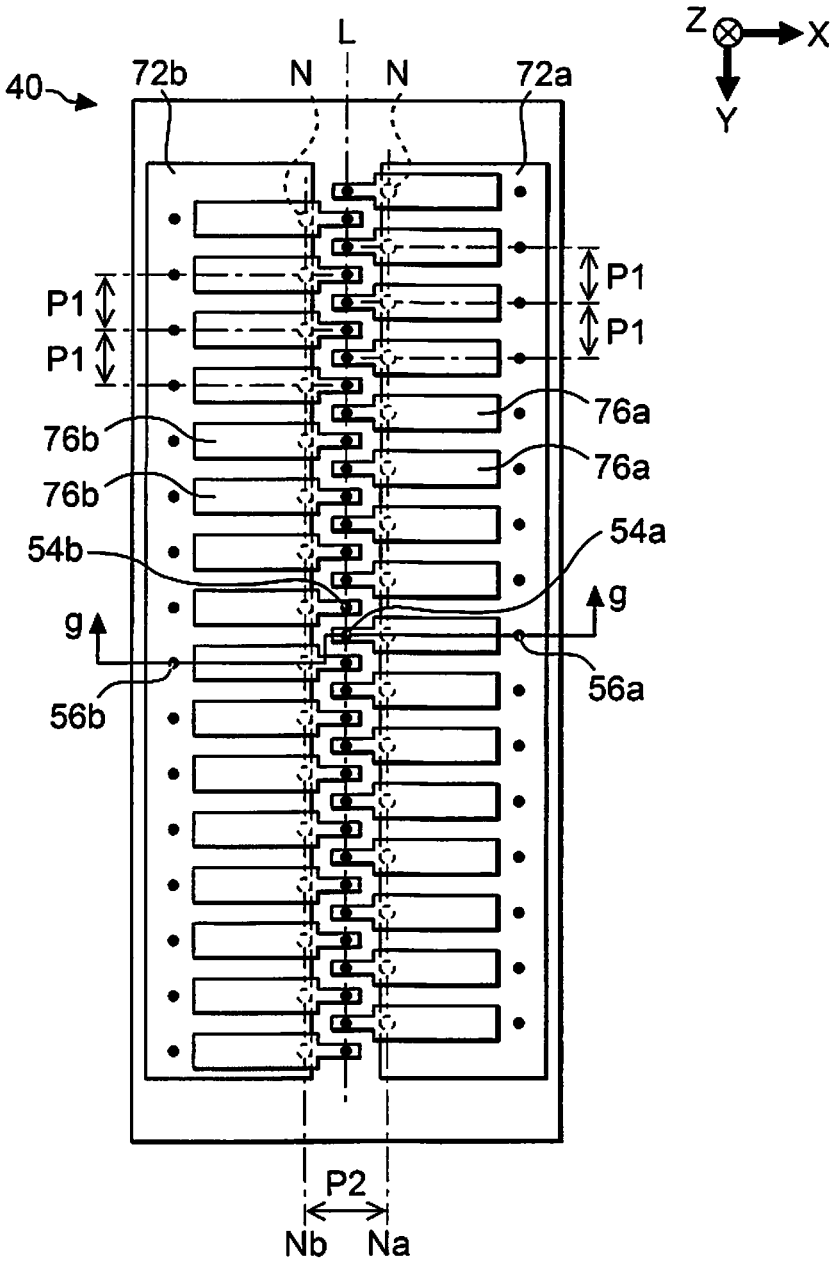
FIG. 4 illustrates the arrangement of drive electrodes provided to an actuator substrate.

FIG. 4 illustrates the arrangement of the drive electrodes of the piezoelectric elements Pzt and the nozzles N provided to the actuator substrate 40. Note that FIG. 4 illustrates a state viewed from the driver IC 50 situated opposite to the medium P in the ink ejection direction. FIG. 4 illustrates a state before the driver IC 50 of the head unit 3 is provided.

The actuator substrate 40 (head unit 3) has a configuration in which a plurality of nozzles N are arranged in two rows (see above). These nozzle rows are referred to as a nozzle row Na (first array) and a nozzle row Nb (second array) for convenience of explanation.

Each of the nozzle rows Na and Nb includes a plurality of nozzles N that are arranged along the Y-direction at a pitch P1. The nozzle rows Na and Nb are spaced in the X-direction by a pitch P2. The nozzles N that belong to the nozzle row Na and the nozzles N that belong to the nozzle row Nb are shifted in the Y-direction by half the pitch P1. It is possible to substantially double the resolution in the Y-direction as compared with the case where the nozzles N are arranged in one row by arranging the nozzles N in the two nozzle rows Na and Nb so that the nozzles N that belong to the nozzle row Na and the nozzles N that belong to the nozzle row Nb are shifted in the Y-direction by half the pitch P1.

Figure 5:
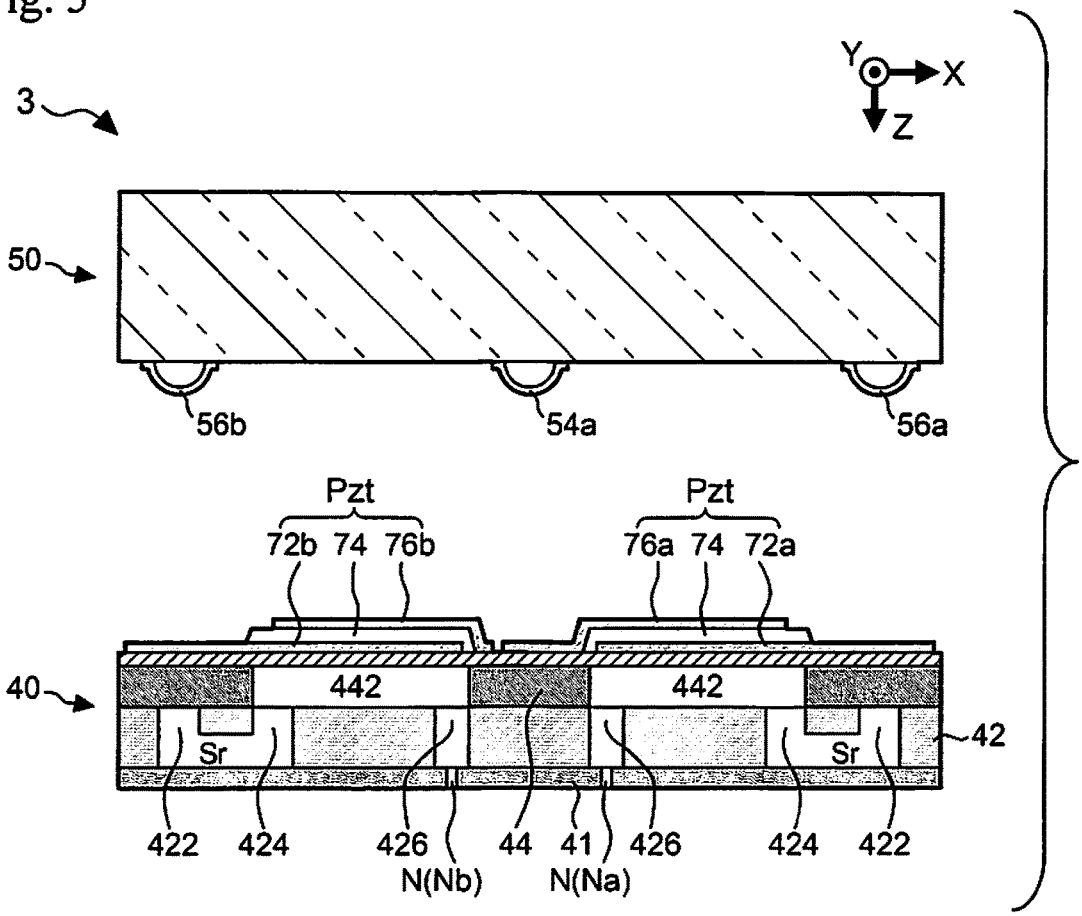
FIG. 5 is a cross-sectional view illustrating the configuration of a head unit.

FIG. 5 is a cross-sectional view illustrating the structure of the actuator substrate 40 taken along the line g-g in FIG. 4. FIG. 5 also illustrates the driver IC 50 that is mounted on the actuator substrate 40.

Figure 6:
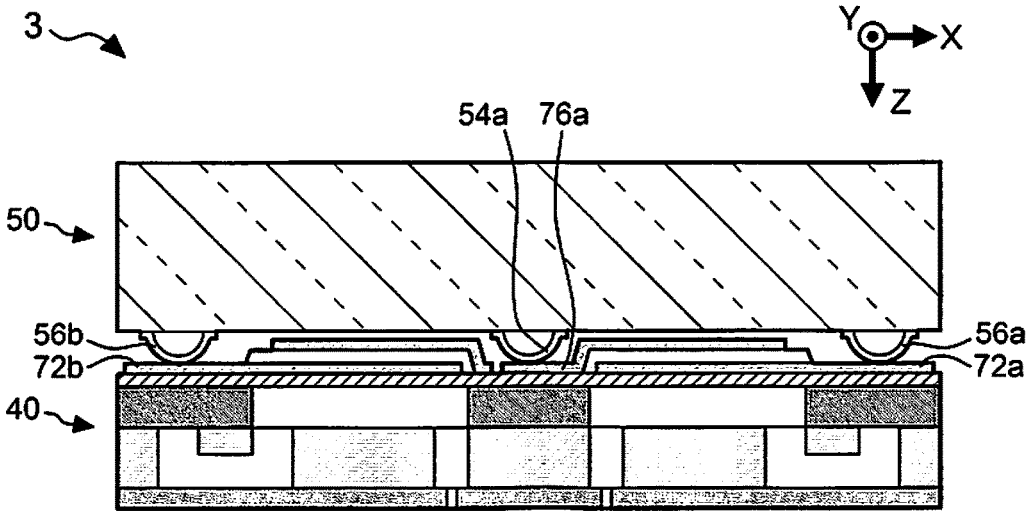
FIG. 6 is a cross-sectional view illustrating the main part of the configuration of a head unit.

FIG. 6 illustrates a state in which the driver IC 50 is mounted on the actuator substrate 40.

As illustrated in FIG. 5, the actuator substrate 40 is a structure in which a pressure chamber substrate 44 and a diaphragm 46 are provided on the −Z-direction-side surface of a flow channel substrate 42, and a nozzle plate 41 is provided on the +Z-direction-side surface of the flow channel substrate 42.

Each element of the actuator substrate 40 is an approximately tabular member that extends in the Y-direction, and is secured with an adhesive, for example. The flow channel substrate 42 and the pressure chamber substrate 44 are formed of a monocrystalline silicon substrate, for example.

The nozzles N are formed in the nozzle plate 41. As described above with reference to FIG. 4, the actuator substrate 40 is formed so that the structure that corresponds to the nozzles that belong to the nozzle row Na and the structure that corresponds to the nozzles that belong to the nozzle row Nb are shifted in the Y-direction by half the pitch P1, but are formed to be approximately symmetrical to each other. The structure of the actuator substrate 40 is described below by focusing on the nozzle row Na.

The flow channel substrate 42 is a tabular material that forms an ink flow channel. An opening 422, a supply flow channel 424, and a communication flow channel 426 are formed in the flow channel substrate 42. The supply flow channel 424 and the communication flow channel 426 are formed on a nozzle basis. The opening 422 is continuously formed over a plurality of nozzles, and an ink in the corresponding color is supplied to the opening 422. The opening 422 functions as a liquid reservoir Sr, and the bottom of the liquid reservoir Sr is formed by the nozzle plate 41, for example. More specifically, the nozzle plate 41 is secured on the bottom of the flow channel substrate 42 so as to close the opening 422, the supply flow channel 424, and the communication flow channel 426 formed in the flow channel substrate 42.

The diaphragm 46 is provided on the surface of the pressure chamber substrate 44 that is situated opposite to the flow channel substrate 42. The diaphragm 46 is a tabular member that can vibrate elastically. For example, the diaphragm 46 is a laminate that includes an elastic film that is formed of an elastic material (e.g., silicon oxide), and an insulating film that is formed of an insulating material (e.g., zirconium oxide). The diaphragm 46 and the flow channel substrate 42 face each other at an interval inside each opening 422 of the pressure chamber substrate 44. The space that is formed by each opening 422 and situated between the flow channel substrate 42 and the diaphragm 46 functions as a cavity 442 that applies pressure to the ink. Each cavity 442 communicates with the nozzle N through the communication flow channel 426 formed in the flow channel substrate 42.

The piezoelectric element Pzt is formed on the surface of the diaphragm 46 that is situated opposite to the pressure chamber substrate 44, the piezoelectric element Pzt being provided corresponding to each nozzle N (cavity 442).

The piezoelectric element Pzt includes a drive electrode 72*a* that is formed on the surface of the diaphragm 46 and provided common to a plurality of piezoelectric elements Pzt that correspond to the nozzle row Na, a piezoelectric material 74 that is formed on the surface of the drive electrode 72*a*, and a drive electrode 76*a* that is formed on the surface of the piezoelectric material 74 and provided corresponding to each piezoelectric element Pzt. An area in which the piezoelectric material 74 is sandwiched between the drive electrodes 72*a* and 76*a* functions as the piezoelectric element Pzt.

Note that the piezoelectric element Pzt that corresponds to the nozzle row Nb includes a drive electrode 72*b*, the piezoelectric material 74, and a drive electrode 76*b*. Note that the drive electrodes of the piezoelectric element Pzt that corresponds to the nozzle row Na are referred to as the drive electrodes 72*a* and 76*a*, and the drive electrodes of the piezoelectric element Pzt that corresponds to the nozzle row Nb are referred to as the drive electrodes 72*b* and 76*b* in order to electrically discriminate the piezoelectric element Pzt that corresponds to the nozzle row Na and the piezoelectric element Pzt that corresponds to the nozzle row Nb. The drive electrodes 72*a* and 72*b* are separated physically, but are connected electrically since the voltage $V_{BS}$ is applied in common to the drive electrodes 72*a* and 72*b*.

The piezoelectric material 74 is formed by a process that includes a heat treatment (calcining), for example. Specifically, the piezoelectric material 74 is formed by applying a piezoelectric substance to the surface of the diaphragm 46 on which the drive electrodes 72*a* and 72*b* are formed, calcining the piezoelectric substance by performing a heat treatment inside a calcination furnace, and forming (e.g., plasma milling) the calcined piezoelectric substance corresponding to each piezoelectric element Pzt.

Although an example in which the drive electrode 72*a* (72*b*) is provided under the piezoelectric material 74 and the drive electrode 76*a* (76*b*) (independent drive electrode) is provided on the piezoelectric material 74 has been described above, the drive electrode 72*a* (72*b*) may be provided on the piezoelectric material 74, and the drive electrode 76*a* (76*b*) may be provided under the piezoelectric material 74.

As described above, the voltage Vout of the drive signal that corresponds to the amount of ink that should be ejected is independently applied to the drive electrode 76*a* (76*b*) (i.e., one end) of the piezoelectric element Pzt, and the voltage $V_{BS}$ hold signal (that is constant temporally) is applied to the drive electrode 72*a* (72*b*) (i.e., the other end) of the piezoelectric element Pzt. The piezoelectric element Pzt is displaced upward or downward corresponding to the voltage Vout of the drive signal applied to the drive electrode 76*a* (76*b*).

More specifically, the center part of the piezoelectric element Pzt is deformed upward with respect to each end when the voltage Vout of the drive signal applied through the drive electrode 76*a* (76*b*) has decreased, and deformed downward when the voltage Vout has increased.

When the center part of the piezoelectric element Pzt has been deformed upward, the inner volume of the cavity 442 increases (i.e., a decrease in pressure occurs), and the ink is introduced from the liquid reservoir Sr. On the other hand, when the center part of the piezoelectric element Pzt has been deformed downward, the inner volume of a pressure chamber Sc decreases (i.e., an increase in pressure occurs), and an ink droplet is ejected from the nozzle N corresponding to the decrease in the inner volume of the pressure chamber Sc. Specifically, when an appropriate drive signal has been applied to the piezoelectric element Pzt, the ink is ejected from the nozzle N due to the displacement of the piezoelectric element Pzt. Therefore, the elements including the piezoelectric element Pzt, the pressure chamber Sc, the nozzle N, and the like form the ejection section that ejects the ink.

When two arbitrary ejection sections among the ejection sections that correspond to the nozzle row Na are referred to as a first ejection section and a second ejection section, the piezoelectric element Pzt included in the first ejection section corresponds to the first actuator, and the piezoelectric element Pzt included in the second ejection section corresponds to the second actuator. When two arbitrary ejection sections among the ejection sections that correspond to the nozzle row Nb are referred to as a third ejection section and a fourth ejection section, the piezoelectric element Pzt included in the third ejection section corresponds to the third actuator, and the piezoelectric element Pzt included in the fourth ejection section corresponds to the fourth actuator.

The arrangement of the drive electrodes 72*a*, 72*b*, 76*a*, and 76*b* of the piezoelectric elements Pzt having the above structure is described below with reference to FIG. 4. Note that the piezoelectric material 74 is omitted in FIG. 4.

As illustrated in FIG. 4, the drive electrode 72*a* that corresponds to the nozzle row Na and the drive electrode 72*b* that corresponds to the nozzle row Nb are patterned to have a rectangular shape that extends in the Y-direction in a plan view. The drive electrodes 76*a* are formed on the drive electrode 72*a* through the piezoelectric material 74 (not illustrated in FIG. 4) corresponding to the nozzles N that belong to the nozzle row Na. Part of the drive electrode 76*a* projects leftward so as to extend beyond a centerline L that extends along the Y-direction (see FIG. 4).

The drive electrodes 76*b* are formed on the drive electrode 72*b* (through the piezoelectric material 74) corresponding to the nozzles N that belong to the nozzle row Nb. Part of the drive electrode 76*b* projects rightward so as to extend beyond the centerline L (see FIG. 4).

Note that bumps 54*a* or 54*b* of the driver IC 50 are connected to the drive electrode 76*a* or 76*b* at the positions that correspond to the intersections of the drive electrode 76*a* or 76*b* and the centerline L and are indicated by the black circles.

Bumps 56*a* of the driver IC 50 are connected to the drive electrode 72*a* at the positions respectively indicated by the black circles that are arranged along the right edge of the actuator substrate 40 in an area in which the drive electrodes 76*a* are not formed. Likewise, bumps 56*b* of the driver IC 50 are connected to the drive electrode 72*b* at the positions respectively indicated by the black circles that are arranged along the left edge of the actuator substrate 40 in an area in which the drive electrodes 76*b* are not formed.

Figure 7:
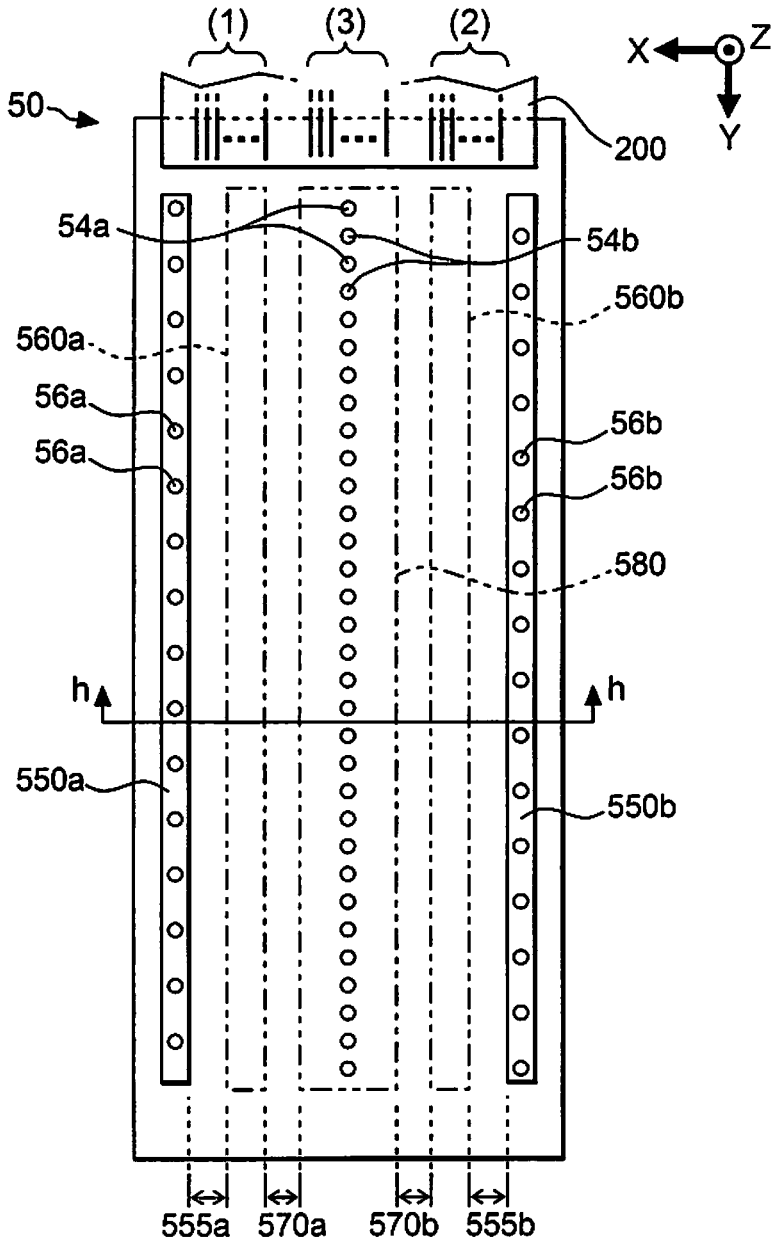
FIG. 7 illustrates the mounting surface of a driver IC.

FIG. 7 is a plan view illustrating the mounting surface of the driver IC 50.

As illustrated in FIG. 7, the bumps 54*a* and 54*b* are arranged alternately in one row along the Y-direction at approximately the center of the driver IC 50. The elements of the selection sections 520 are formed in an area 580 that has a rectangular shape that extends in the Y-direction and includes the bumps 54*a* and 54*b*. Specifically, high-voltage transistors are formed in the area 580.

Note that one selection section 520 corresponds to the bump 54*a* or 54*b*.

The bump 54*a* is connected to the drive electrode 76*a* provided to the actuator substrate 40 that corresponds to the nozzle row Na, and the bump 54*b* is connected to the drive electrode 76*b* provided to the actuator substrate 40 that corresponds to the nozzle row Nb (as described later).

Therefore, a plurality of bumps 54*a* correspond to the first electrode group, a bump 54*a* among the plurality of bumps 54*a* that is connected to the drive electrode 76*a* (i.e., one end) of the piezoelectric element Pzt that serves as the first actuator corresponds to the first electrode, and a bump 54*a* among the plurality of bumps 54*a* that is connected to the drive electrode 76*a* (i.e., one end) of the piezoelectric element Pzt that serves as the second actuator corresponds to the second electrode.

Likewise, a plurality of bumps 54*b* correspond to the second electrode group, a bump 54*b* among the plurality of bumps 54*b* that is connected to the drive electrode 76*b* (i.e., one end) of the piezoelectric element Pzt that serves as the third actuator corresponds to the third electrode, and a bump 54*b* among the plurality of bumps 54*b* that is connected to the drive electrode 76*b* (i.e., one end) of the piezoelectric element Pzt that serves as the fourth actuator corresponds to the fourth electrode.

Since a circuit that includes a transistor and the like and supplies the drive signal through the bumps 54*a* and 54*b* is formed in the area 580, the area 580 corresponds to the first circuit block.

A wiring pattern 550*a* is provided along the Y-direction along the +X-direction (left)-side edge of the driver IC 50. The wiring pattern 550*a* includes a plurality of bumps 56*a* that are provided along one side of the driver IC 50. The plurality of bumps 56*a* are respectively connected to the drive electrodes 72*a*. Therefore, the wiring pattern 550*a* and the drive electrode 72*a* are electrically connected in parallel.

Note that the plurality of bumps 56*a* correspond to the third electrode group. The wiring pattern 550*a* relays (supplies) the hold signal from the main board 100 to each of the plurality of bumps 56*a*, and corresponds to the second circuit block.

The driver IC 50 is formed so that an area 560*a* is provided between the wiring pattern 550*a* and the area 580.

A wiring pattern 550*b* is provided along the Y-direction along the −X-direction (right)-side edge of the driver IC 50. The wiring pattern 550*b* includes a plurality of bumps 56*b* that are provided along the side of the driver IC 50 that is opposite to the one side. The plurality of bumps 56*b* are respectively connected to the drive electrodes 72*b*. Therefore, the wiring pattern 550*b* and the drive electrode 72*b* are electrically connected in parallel.

Note that the plurality of bumps 56*b* correspond to the fourth electrode group. The wiring pattern 550*b* relays (supplies) the hold signal from the main board 100 to each of the plurality of bumps 56*b*, and corresponds to the third circuit block.

The driver IC 50 is formed so that an area 560*b* is provided between the wiring pattern 550*b* and the area 580.

The elements of the selection control section 510 are formed in the areas 560*a* and 560*b*. Specifically, low-voltage transistors are formed in the areas 560*a* and 560*b*. Although FIG. 7 illustrates an example in which the areas 560*a* and 560*b* are separated from each other, the areas 560*a* and 560*b* may be connected to each other on the +Y-direction (lower)-side end, for example.

The driver IC 50 is configured so that lines 200 that branch from the flexible cable 190 (see FIG. 1) are connected to the −Y-direction (upper)-side end of the driver IC 50, and the control signal Ctr, the drive signals COM-A and COM-B, and the voltage $V_{BS}$ hold signal are supplied to the driver IC 50 from the main board 100. More specifically, the low-amplitude logic control signal Ctr and a low-voltage signal (e.g., low-voltage power supply signal) are supplied through a left line group (1) and a right line group (2) included in the lines 200 (see FIG. 7), and the high-voltage drive signals COM-A and COM-B and a high-voltage signal (e.g., high-voltage power supply signal) are supplied through a center line group (3), for example. The voltage $V_{BS}$ hold signal is supplied through the line group (1) and the line group (2) as a low-voltage signal, for example.

Since the high-voltage signal and the low-voltage signal are separately supplied to the driver IC 50 through the lines 200, it is possible to reduce or suppress the occurrence of interference.

Note that the voltage $V_{BS}$ hold signal may be supplied through the line group (3) as a high-voltage signal, and delivered to the right side and the left side.

The mounting surface of the driver IC 50 (see FIG. 7) is mounted on (face-down bonded to) the surface of the actuator substrate 40 on which the electrodes are formed (see FIG. 4) (see FIG. 6).

After the driver IC 50 has been mounted on (face-down bonded to) the actuator substrate 40, the peripheral area of the bonding part is sealed with a sealing material. This makes it possible to prevent deterioration in the piezoelectric element Pzt (piezoelectric material 74).

When the driver IC 50 is face-down bonded to the actuator substrate 40, the bump 54*a* and the bump 54*b* are respectively connected to the drive electrode 76*a* and the drive electrode 76*b* so that the drive signal (voltage Vout) is applied to one end of the piezoelectric element Pzt from the corresponding selection section 520, and the bump 56*a* and the bump 56*b* are respectively connected to the drive electrode 72*a* and the drive electrode 72*b* so that the voltage $V_{BS}$ is applied in common to the other end of the piezoelectric element Pzt.

Since the drive electrode 72*a* and the wiring pattern 550*a* are connected in parallel through the bump 56*a*, and the drive electrode 72*b* and the wiring pattern 550*b* are connected in parallel through the bump 56*b*, the resistance of the voltage $V_{BS}$ path of the head unit 3 (through which the voltage $V_{BS}$ is applied) decreases. Since the voltage $V_{BS}$ is stabilized even if a relatively large amount of current flows through the voltage $V_{BS}$ path due to a decrease in resistance, it is possible to improve the ink ejection accuracy, and implement high-quality printing.

Figure 8:
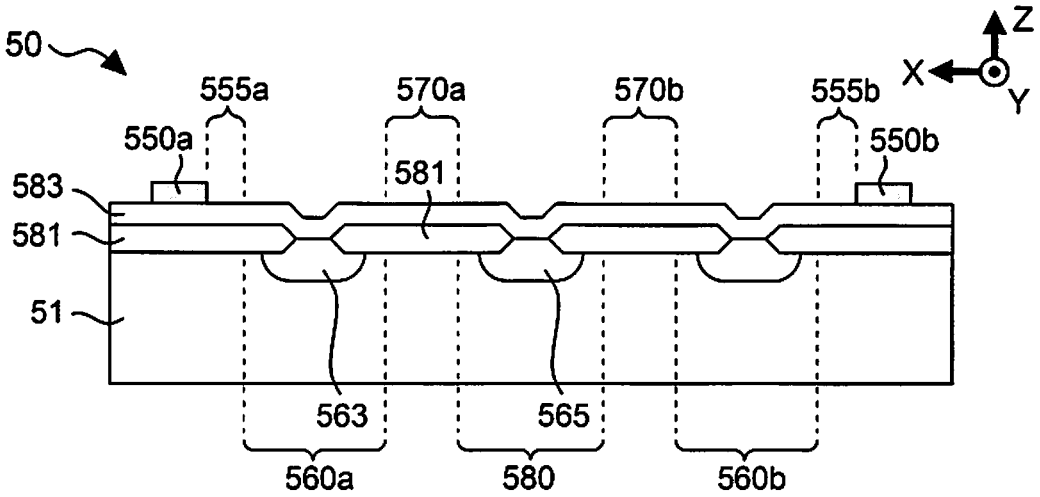
FIG. 8 is a partial cross-sectional view illustrating the configuration of a driver IC.

FIG. 8 is a cross-sectional view illustrating the main part of the structure of the driver IC 50 taken along the line h-h in FIG. 7. Note that the expression "A is formed over B" used hereinafter means that A is formed temporally after B during a semi-conductor process, and is irrelevant to the position in the gravitational direction.

As illustrated in FIG. 8, the driver IC 50 has a structure in which an oxide film 581 is locally formed on an Si substrate 51 by a LOCOS (local oxidation of silicon) method to form an element isolation region. A P-type doped region 563 and an N-type doped region 565 are formed in the areas in which the oxide film 581 is not formed by ion implantation (dopant implantation) that utilizes the oxide film 581 as a mask. An interlayer insulating film (interlayer dielectric) 583 is formed to cover the oxide film 581, the P-type doped region 563, and the N-type doped region 565.

The high-voltage transistors and the like that form the selection section 520 are formed in the area 580. The low-voltage transistors and the like that form the selection control section 510 are formed in the areas 560*a* and 560*b*.

Note that the interlayer insulating film 583 is a multi-layer film, and a wiring layer is formed between the films that form the multi-layer film. Although FIG. 8 illustrates an example in which only the P-type doped region 563 is formed in the area 560*a*, an N-type doped region may also be formed in the area 560*a*. Likewise, although FIG. 8 illustrates an example in which only the N-type doped region 565 is formed in the area 580, a P-type doped region may also be formed in the area 580.

The wiring pattern 550*a* is provided over a non-doped region that is situated on the outer side (left side) with respect to the area 560*a* and does not fall under the P-type doped region 563 and the N-type doped region 565. Likewise, the wiring pattern 550*b* is provided over a non-doped region that is situated on the outer side (right side) with respect to the area 560*b*. More specifically, the wiring patterns 550*a* and 550*b* are formed by forming a pattern of a metal layer (e.g., copper or aluminum layer) in the non-doped region of the Si substrate 51 (into which ions are not implanted, or a negligible trace amount of ions are implanted) through the oxide film 581 and the interlayer insulating film 583.

Although FIG. 8 illustrates a state in which the wiring patterns 550*a* and 550*b* include only one layer, it is preferable to employ a configuration in which a plurality of wiring layers are connected.

As described above, the resistance of the voltage $V_{BS}$ path of the head unit 3 decreases as a result of connecting the drive electrode 72*a* (72*b*) and the wiring pattern 550*a* (550*b*) in parallel. However, a relatively large amount of current flows through the voltage $V_{BS}$ path. Therefore, the driver IC 50 may malfunction due to noise caused by a large amount of current that flows through the voltage $V_{BS}$ path when no measures are taken. According to the first embodiment, however, since the wiring patterns 550*a* and 550*b* are formed over the non-doped region, it is possible to reduce the possibility that malfunction occurs due to noise.

Figure 9:
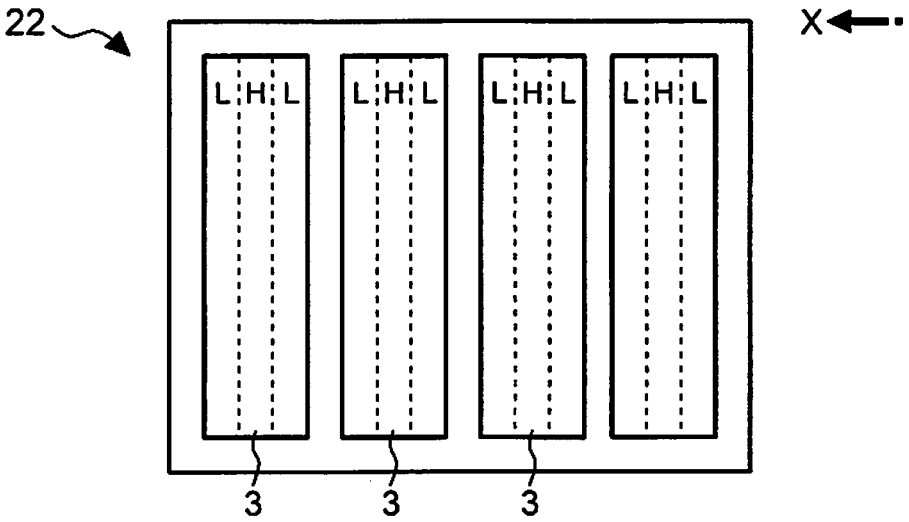
FIG. 9 illustrates the relationship between the arrangement of head units and a circuit configuration.

FIG. 9 illustrates the positional relationship between the areas 560*a*, 580, and 560*b* when four head units 3 are arranged. Note that the area 580 in which a high-voltage transistor and the like are formed is referred to as "H", and the areas 560*a* and 560*b* in which a low-voltage transistor and the like are formed are referred to as "L".

As described above, the print head 22 includes four head units 3 that are arranged along the X-direction. Each head unit 3 has a configuration in which the area H in which a high-voltage transistor and the like are formed is situated between the areas L in which a low-voltage transistor and the like are formed. Specifically, each head unit 3 has a configuration in which the area H is situated at the center, and the area L is situated on each side of the area H (LHL).

If each head unit 3 has a configuration in which the area L is situated at the center, and the area H is situated on each side of the area L (HLH), the areas H of the contiguous head units 3 are situated close to each other, and interference between the high-voltage signals easily occurs.

According to the configuration illustrated in FIG. 9, the areas L of the contiguous head units 3 are situated close to each other. However, since the low-voltage signal flows through the areas L, and the areas H are situated away from each other, it is possible to reduce or suppress interference between the contiguous head units 3.

The mounting surface illustrated in FIG. 7 is designed as described below. Specifically, the area 580 (in which a high-voltage transistor and the like are formed) and the area 560*a* (in which a low-voltage transistor and the like are formed) are isolated from each other through a buffer area 570*a*, and the area 580 and the area 560*b* are isolated from each other through a buffer area 570*b*. The wiring pattern 550*a* is isolated from the area 560*a* through a buffer area 555*a*, and the wiring pattern 550*b* is isolated from the area 560*b* through a buffer area 555*b*. Note that the buffer area is a non-doped region.

Figure 10:
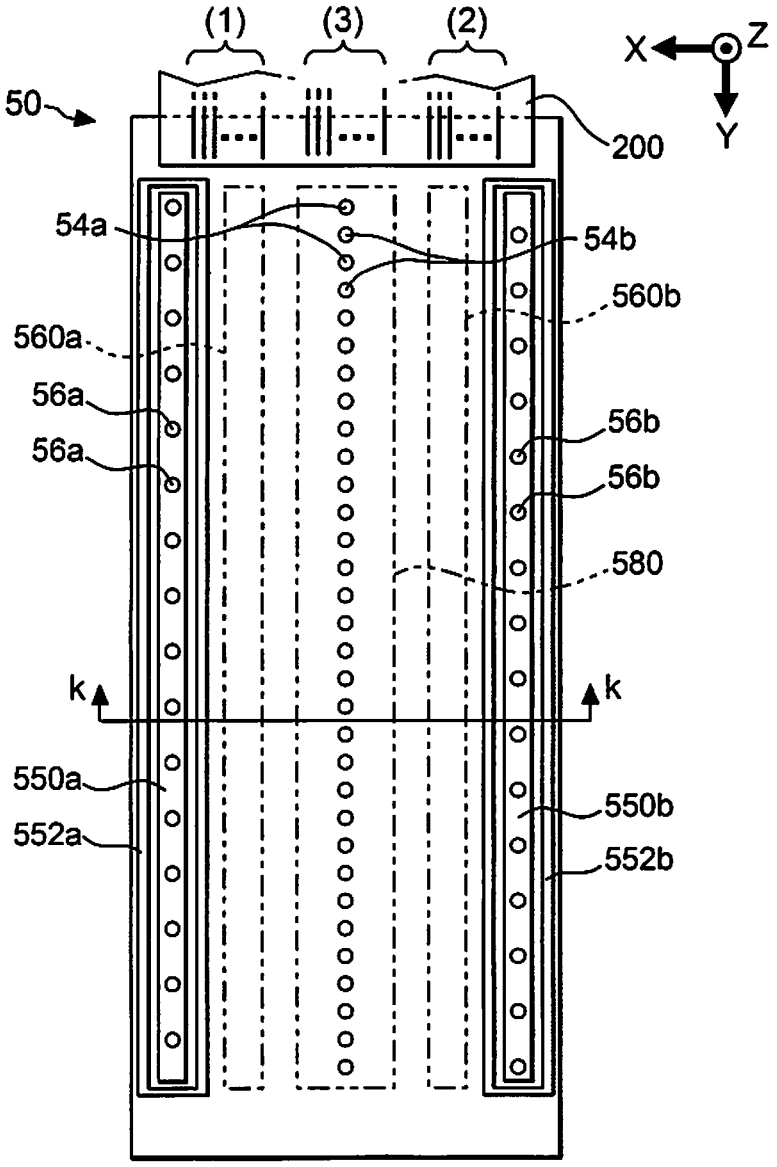
FIG. 10 illustrates the mounting surface of a driver IC included in a printer according to the second embodiment.
Figure 11:
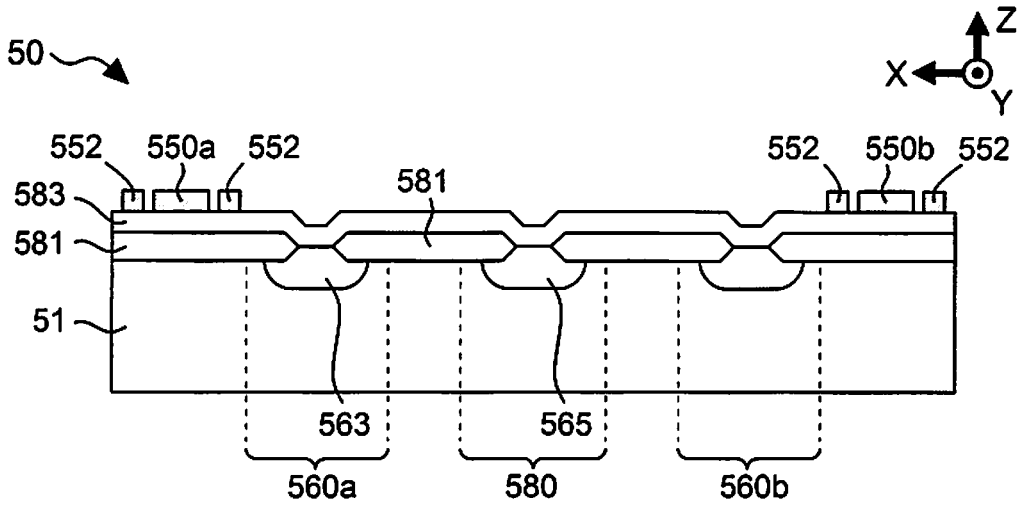
FIG. 11 is a partial cross-sectional view illustrating the configuration of a driver IC.

FIG. 10 is a plan view illustrating the mounting surface of the driver IC 50 applied to a printer 1 according to a second embodiment. FIG. 11 is a cross-sectional view illustrating the main part of the structure of the driver IC 50 taken along the line k-k in FIG. 10.

As illustrated in FIGS. 10 and 11, a wiring pattern 552*a* (guard wiring section) is provided to surround the wiring pattern 550*a* so that the wiring pattern 552*a* is electrically insulated from the wiring pattern 550*a*. The wiring pattern 552*a* is formed in (over) the non-doped region, and isolated from the area 560*a*.

Likewise, a wiring pattern 552*b* is provided to surround the wiring pattern 550*b* so that the wiring pattern 552*b* is electrically insulated from the wiring pattern 550*b*. The wiring pattern 552*b* is formed in (over) the non-doped region, and isolated from the area 560*b*.

The wiring patterns 552*a* and 552*b* are grounded.

According to this configuration, since the wiring pattern 550*a* (550*b*) is surrounded by the wiring pattern 552*a* (552*b*) that is set to the ground potential, it is possible to reduce the effect of a change in the voltage $V_{BS}$ of the wiring pattern 550*a* (550*b*) on the circuit formed in the area 560*a*.

Figure 12:
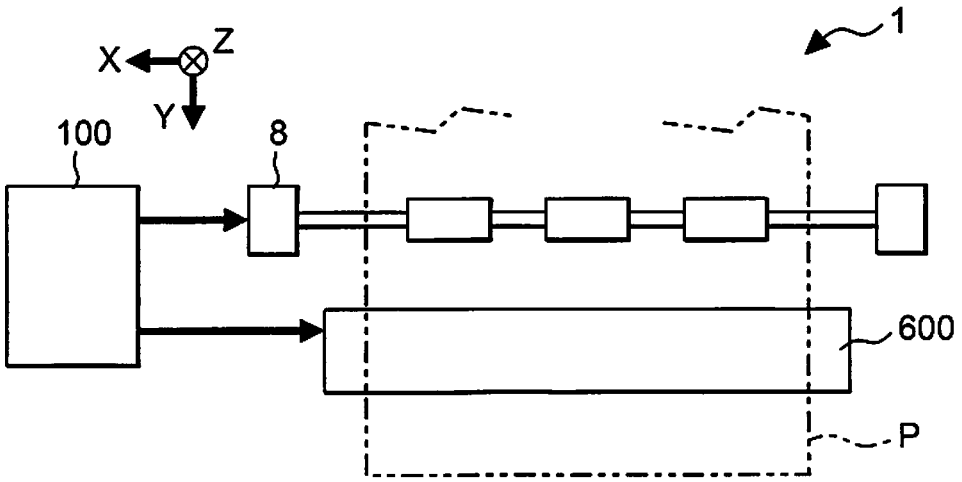
FIG. 12 illustrates a schematic configuration of a printer according to the third embodiment.

FIG. 12 illustrates the configuration of a printer 1 according to the third embodiment. The printer 1 according to the third embodiment includes the main board 100, the feed mechanism 8 that feeds the medium P in the Y-direction, and a print head 600.

The printer 1 according to the third embodiment is a line printer in which the print head 600 is not moved, and does not include the moving mechanism 6. The print head 600 extends in the X-direction that is orthogonal to the feed direction (Y-direction).

Figure 13:
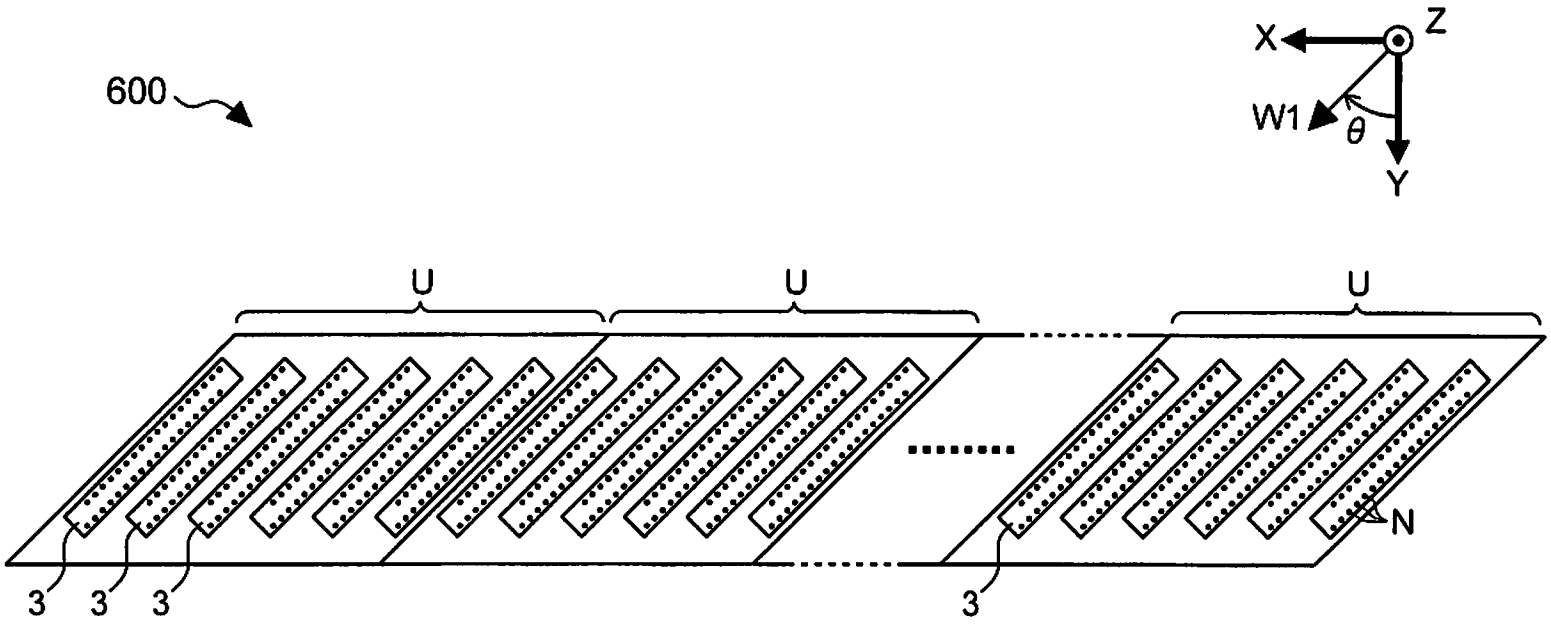
FIG. 13 is a plan view illustrating the configuration of a head unit.

FIG. 13 is a plan view illustrating the print head 22 viewed from the medium P.

As illustrated in FIG. 13, the print head 22 has a configuration in which a plurality of basic modules U are arranged along the X-direction. The module U includes a plurality of (e.g., six) head units 3 that are arranged along the X-direction. The head unit 3 is configured in the same manner as described above in connection with the first embodiment. A plurality of nozzles N are arranged along a W1-direction that is tilted by an angle θ with respect to the Y-direction (i.e., the feed direction in which the medium P is fed).

The printer 1 forms an image on the surface of the medium P by causing each head unit 3 to eject the ink toward the medium P in synchronization with the feed of the medium P in the Y-direction.

Figure 14:
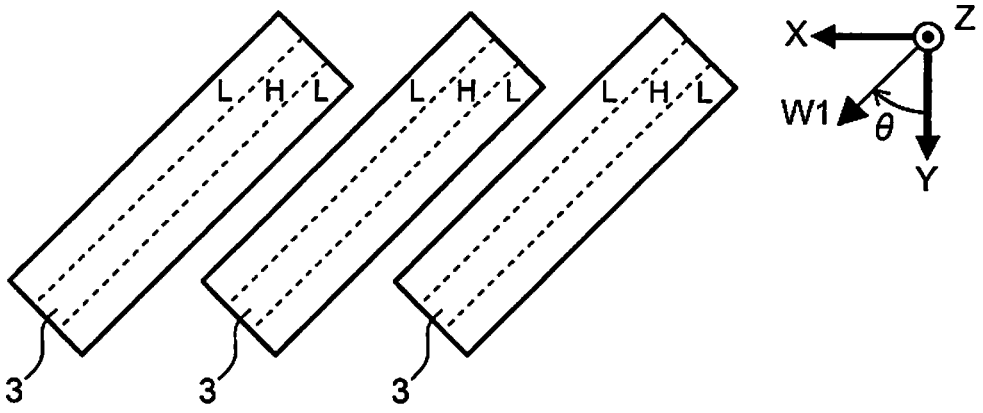
FIG. 14 illustrates the relationship between the arrangement of head units and a circuit configuration.

FIG. 14 illustrates the arrangement of the area H (in which a high-voltage transistor and the like are formed) and the area L (in which a low-voltage transistor and the like are formed) included in the head unit 3.

As illustrated in FIG. 14, since the areas L of the contiguous head units 3 of the diagonal head are situated close to each other, and the areas H are situated away from each other, it is possible to reduce or suppress interference between the contiguous head units 3.

Although an example in which the voltage $V_{BS}$ hold signal from the main board 100 is applied to the actuator substrate 40 through the driver IC 50 has been described above, the voltage $V_{BS}$ hold signal from the main board 100 may be supplied directly to the actuator substrate 40. In either case, the resistance of the voltage $V_{BS}$ path decreases since the drive electrode 72*a* (72*b*) and the wiring pattern 550*a* (550*b*) are connected in parallel.

Although an example in which the liquid ejecting device is a printer has been described above, the liquid ejecting device may be a three-dimensional printer that forms a three-dimensional object by ejecting a liquid, a printer that dyes cloth by ejecting a liquid, or the like.

REFERENCE SIGNS LIST

1: printer (liquid ejecting device), 3: head unit, 50: driver IC, 54*a*, 54*b*, 56*a*, 56*b*: bump, 40: actuator substrate (structure), 442: cavity, 100: main board, 550: wiring pattern, Pzt: piezoelectric element, N: nozzle

The invention claimed is:

1. A head unit comprising:

a structure; and a driver IC, the structure including a first array that includes a plurality of ejection sections including a first ejection section that performs an ejection operation upon application of a drive signal to a first actuator, and a second ejection section that performs an ejection operation upon application of the drive signal to a second actuator, and a second array that includes a plurality of ejection sections including a third ejection section that performs an ejection operation upon application of the drive signal to a third actuator, and a fourth ejection section that performs an ejection operation upon application of the drive signal to a fourth actuator, the driver IC including a first electrode group that includes a plurality of electrodes including a first electrode that is electrically connected to one end of the first actuator and supplies the drive signal to the first actuator, and a second electrode that is electrically connected to one end of the second actuator and supplies the drive signal to the second actuator, a second electrode group that includes a plurality of electrodes including a third electrode that is electrically connected to one end of the third actuator and supplies the drive signal to the third actuator, and a fourth electrode that is electrically connected to one end of the fourth actuator and supplies the drive signal to the fourth actuator, a third electrode group that includes a plurality of electrodes that are electrically connected to the other end of the first actuator and the other end of the second actuator, and a fourth electrode group that includes a plurality of electrodes that are electrically connected to the other end of the third actuator and the other end of the fourth actuator, the driver IC being mounted on the structure, and the first electrode group, the second electrode group, the third electrode group and the fourth electrode group being provided on a mounting surface of the driver IC that is mounted on the structure, wherein, when the driver IC is viewed perpendicular to the mounting surface of the driver IC, the third electrode group is arranged along one side of the driver IC, the fourth electrode group is arranged along a side of the driver IC that differs from the one side, and an area in which the first electrode group and the second electrode group are arranged is situated between an area in which the third electrode group is arranged and an area in which the fourth electrode group is arranged.

2. The head unit as defined in claim 1, wherein a hold signal is applied in common to the third electrode group and the fourth electrode group.

3. The head unit as defined in claim 1, wherein the third electrode group and the fourth electrode group are formed over a non-doped region of the driver IC when viewed perpendicular to the mounting surface.

4. The head unit as defined in claim 1, wherein the area in which the first electrode group and the second electrode group are arranged is isolated from each of the third electrode group and the fourth electrode group through a buffer area.

5. The head unit as defined in claim 1, further comprising a guard wiring section provided between the area in which the first electrode group and the second electrode group are arranged, and the area in which the third electrode group is arranged, and between the area in which the first electrode group and the second electrode group are arranged, and the area in which the fourth electrode group is arranged, when viewed perpendicular to the mounting surface.

6. A head unit comprising:

a structure; and a driver IC, the structure including a first array that includes a plurality of ejection sections including a first ejection section that performs an ejection operation upon application of a drive signal to a first actuator, and a second ejection section that performs an ejection operation upon application of the drive signal to a second actuator, and a second array that includes a plurality of ejection sections including a third ejection section that performs an ejection operation upon application of the drive signal to a third actuator, and a fourth ejection section that performs an ejection operation upon application of the drive signal to a fourth actuator, the driver IC including a first circuit block that includes a first electrode group that includes a plurality of electrodes including a first electrode that is electrically connected to one end of the first actuator and a second electrode that is electrically connected to one end of the second actuator, and a second electrode group that includes a plurality of electrodes including a third electrode that is electrically connected to one end of the third actuator and a fourth electrode that is electrically connected to one end of the fourth actuator, and supplies the drive signal to the first electrode group and the second electrode group, a second circuit block that includes a third electrode group that includes a plurality of electrodes that are electrically connected to the other end of the first actuator and the other end of the second actuator, and supplies a hold signal to the third electrode group, and a third circuit block that includes a fourth electrode group that includes a plurality of electrodes that are electrically connected to the other end of the third actuator and the other end of the fourth actuator, and supplies the hold signal to the fourth electrode group, the driver IC being mounted on the structure, and the first electrode group, the second electrode group, the third electrode group and the fourth electrode group being provided on a mounting surface of the driver IC that is mounted on the structure, wherein, when the driver IC is viewed perpendicular to the mounting surface of the driver IC, the second circuit block is situated along one side of the driver IC, the third circuit block is situated along a side of the driver IC that differs from the one side, and the first circuit block is situated between the second circuit block and the third circuit block.

7. A liquid ejecting device comprising:

a head unit; and a relative moving section that moves the head unit relative to a medium, the head unit including a structure, and a driver IC, the structure including a first array that includes a plurality of ejection sections including a first ejection section that performs an ejection operation upon application of a drive signal to a first actuator, and a second ejection section that performs an ejection operation upon application of the drive signal to a second actuator, and a second array that includes a plurality of ejection sections including a third ejection section that performs an ejection operation upon application of the drive signal to a third actuator, and a fourth ejection section that performs an ejection operation upon application of the drive signal to a fourth actuator, the driver IC including a first electrode group that includes a plurality of electrodes including a first electrode that is electrically connected to one end of the first actuator and supplies the drive signal to the first actuator, and a second electrode that is electrically connected to one end of the second actuator and supplies the drive signal to the second actuator, a second electrode group that includes a plurality of electrodes including a third electrode that is electrically connected to one end of the third actuator and supplies the drive signal to the third actuator, and a fourth electrode that is electrically connected to one end of the fourth actuator and supplies the drive signal to the fourth actuator, a third electrode group that includes a plurality of electrodes that are electrically connected to the other end of the first actuator and the other end of the second actuator, and a fourth electrode group that includes a plurality of electrodes that are electrically connected to the other end of the third actuator and the other end of the fourth actuator, the driver IC being mounted on the structure, and the first electrode group, the second electrode group, the third electrode group and the fourth electrode group being provided on a mounting surface of the driver IC that is mounted on the structure, wherein, when the driver IC is viewed perpendicular to the mounting surface of the driver IC, the third electrode group is arranged along one side of the driver IC, the fourth electrode group is arranged along a side of the driver IC that differs from the one side, and an area in which the first electrode group and the second electrode group are arranged is situated between an area in which the third electrode group is arranged and an area in which the fourth electrode group is arranged.

8. The liquid ejecting device as defined in claim 7, wherein a plurality of the head units are arranged in parallel when viewed perpendicular to a liquid ejection plane.

* * * * *